United States Patent [19]

Emeric et al.

[11] Patent Number: 4,880,478

[45] Date of Patent: Nov. 14, 1989

[54] PROTECTIVE COATING FOR STEEL SURFACES AND METHOD OF APPLICATION

[75] Inventors: Dario A. Emeric, Alexandria; Christopher E. Miller, Burke; Bryan Westich, Woodbridge; Lisa R. Whiting, Centerville, all of Va.

[73] Assignee: The United States of America as represented by the Secretary of the Army, Washington, D.C.

[21] Appl. No.: 288,357

[22] Filed: Dec. 22, 1988

[51] Int. Cl.[4] ..... C23C 22/13

[52] U.S. Cl. ..... 148/248; 148/259

[58] Field of Search ..... 148/248, 259

[56] References Cited

U.S. PATENT DOCUMENTS

| | | | |
|---|---|---|---|
| 2,493,327 | 1/1950 | Vance | 148/259 |
| 2,502,441 | 4/1950 | Dodd | 148/259 |
| 2,854,368 | 9/1958 | Shrier | 148/259 |
| 4,147,566 | 4/1979 | Leonard | 148/248 |
| 4,381,249 | 4/1983 | Boufford | 148/259 |

*Primary Examiner*—Sam Silverberg

*Attorney, Agent, or Firm*—Milton W. Lee; Anthony T. Lane

[57] ABSTRACT

A novel conversion coating composition and a method for treating corroded steel surfaces to convert them into a suitable substrate for accepting organic coatings are provided. Corroded steel surfaces treated with the novel composition of this invention by the improved method of application disclosed in this invention show wet adhesion and salt spray resistance properties markedly superior to those of surfaces which were treated with conventional, prior-art, commercially available compositions.

5 Claims, No Drawings

PROTECTIVE COATING FOR STEEL SURFACES AND METHOD OF APPLICATION

GOVERNMENT INTEREST

The invention described herein may be manufactured and used by or for the United States Government for Governmental purposes without the payment of any royalties and is being assigned to the United States Government.

BACKGROUND OF THE INVENTION

1. Field of Invention

This invention relates to a new coating composition and a method for applying it to convert a corroded steel surface into a suitable substrate for accepting organic coatings. More specifically, it relates to an improved composition and a related method for treating corroded steel surfaces at stage 1 (mild corrosion) and/or stage 2 (pitted corrosion) to render them suitable, without the need for sandblasting, for the application of an organic primer coat.

2. Description of Prior Art

Many methods for protecting steel surfaces exposed to air and water, including salt water, are currently in use. Generally, before a primer or final protective paint coating is applied to a corroded steel surface, it must be cleaned or prepared by sand blasting to the bare metal. After sandblasting, the surface must be degreased. However, for some steel objects, such pretreatment is impractical for environmental, structural, safety and cost reasons. The treatment of mildly corroded steel surfaces without prior full mechanical removal of the surface oxide layer by sandblasting therefore is a most useful technique.

A well-known process for treating steel surfaces before the application of primer and final paint coatings is phosphating, a procedure by which a water-insoluble film of tertiary ferric phosphate is formed on the steel surface by treatment with phosphoric acid or acid phosphate salts. This film is a suitable substrate for primer and final paint coatings.

Also used for the preparation of steel surfaces are tannins and their derivatives. Tannins also are used in combination with phosphoric acid or acid phosphate salts. U.S. Pat. No. 2,502,441, for example, uses an acid phosphate salt, a molybdate or tungstate salt, tannin or catechol, and a wetting agent. U.S. Pat. No. 2,854,368 discloses the use of phosphoric acid and tannin and an alcohol, U.S. Pat. No. 4,293,349 discloses the use of phosphoric acid, zinc or manganous phosphate and nitrates and tannin derivatives.

None of the above combinations of ingredients have proved entirely satisfactory for treating corroded steel exposed to marine environments. Thus, there is a need for a novel composition and method for treating corroded steel surfaces to convert them into substrates suitable for accepting organic coatings without the need for prior sandblasting, specifically for use in a marine environment.

BRIEF SUMMARY AND OBJECTIVES OF THE INVENTION

It is the object of this invention to provide a novel composition for treating corroded steel surfaces and specifically for converting surfaces in stage 1 (mild corrosion) and stage 2 (pitted corrosion) into a passive substrate suitable for accepting the application of a primer and final paint coating. A further object is to provide a method of treatment of such steel surfaces. The specific advantages of this invention, which include the elimination of sandblasting, will become apparent from the following detailed description.

As a result of extensive tests and evaluations comparing each component of our improved composition at various high and low extremes of concentration, the stated ranges of component concentrations were selected. The following Table I identifies the broader formula of our improved composition, listing the various components and their contemplated acceptable ranges of concentration.

TABLE I

| Component | Range of concentration |
|---|---|
| aliphatic alcohol | 2–20% v/v |
| phosphoric acid | 5–15% v/v |
| sodium nitrate | 0.3–3% w/v |
| tannic acid | 0.1–2% w/v |
| zinc nitrate | 0.3–3% w/v |
| an ionic surface active agent | 0.1–1% w/v |
| water, softened or demineralized | balance |

Note:
% v/v denotes volume percent, e.g. ml per 100 ml;
% w/v denotes weight percent, e.g. grams per 100 ml.

The aliphatic alcohol may have 1–5 carbon atoms per molecule. The preferred alcohol is isopropyl alcohol. Either sodium or potassium nitrate may be used. The surface active agent may be the sodium or potassium salt of dodecylbenzene sulfonic acid.

A method for preparing corroded steel surfaces with the composition of this invention is now being described. It follows degreasing of the surface and comprises high-intensity water spraying, draining excess water, applying the composition of this invention, allowing the surface to dry, repeating the above steps, rinsing with aqueous alkali bicarbonate and water, and allowing the surface to dry. At this point, an organic coating is applied.

DESCRIPTION OF PREFERRED EMBODIMENT OF THE INVENTION

In this detailed discussion of the invention, the preferred composition of this invention and the preferred method of application will be described. The preferred composition comprises the following components in Table II:

TABLE II

| Component | Preferred concentration |
|---|---|
| isopropyl alcohol | 5% v/v |
| phosphoric acid | 10% v/v |
| sodium nitrate | 2.0% w/v |
| tannic acid | 1.2% w/v |
| zinc nitrate | 1.5% w/v |
| sodium dodecylbenzenesulfonate (surface-active agent) | 0.6% w/v |
| softened water | balance |

The purpose of each of the components of the composition is explained as follows. The alcohol serves as the solvent for the organic components of the composition. Phosphoric acid reacts with the rust on the steel surface, which is ferric oxide, Fe203, to form ferric phosphate. Tannic acid forms ferric tannate with the ferric oxide of the rust layer. Sodium nitrate accelerates the reactions between ferric oxide and phosphoric and tannic acids and acts as an oxidizer, assuring that the iron compounds formed will be in their ferric, i.e. trivalent, form. Zinc nitrate causes the formation of mixed ferric/zinc phosphates. The surface-active agent acts as a wetting agent. It assures that all parts of the steel surface being treated are wetted with the composition of this invention. An ionic surface-active agent is preferred because nonionic surfactants cause precipitation of certain of the other components of the composition. Water acts as a diluent. It should be free of calcium and magnesium salts as calcium and magnesium form insoluble precipitates with phosphoric acid. Softened, demineralized or distilled water may therefore be used, softened water being adequate.

It should be noted that the components of the composition of this invention act synergistically in converting the rust on a steel surface into a film of ferric/zinc phosphate and ferric tannate which firmly adheres to the steel, and to which in turn an organic paint coating subsequently applied adheres firmly also.

The composition having the foregoing preferred concentration of components is prepared as follows while the mixture is being stirred:

(a) 12 grams of tannic acid are dissolved in 400 ml of water;
(b) 50 ml of isopropanol are added to this solution;
(c) 100 ml of phosphoric acid are added;
(d) 20 grams of sodium nitrate, 15 grams of zinc nitrate and 6 grams of surface active agent are added;
(e) softened water is added to make 1 liter of solution.

Our novel method of applying this composition is used to effect the conversion of a stage 1 (mild corrosion) or stage 2 (pitted corrosion) steel surface into an adherent one which may be coated with an organic coating. The composition cannot be used for stage 3 and stage 4 corrosion because in this state of corrosion, the structural integrity of the metal has been sacrificed. (Stage 1, 2, 3 and 4 corrosion are designations of the National Association of Corrosion Engineers for classifying the degree of corrosion.)

Our method of applying this composition to corroded steel surfaces, following degreasing, comprises the following steps:

(a) high-intensity water spraying of the surface to remove loose corrosion,
(b) draining excess water from the surface, assuring elimination of puddles, which would dilute the components of the conversion coating composition to be subsequently applied,
(c) brushing or spraying on of a first application of the composition of this invention onto the wetted surface,
(d) allowing the surface to dry at least than 12 hours but not more than 24 hours, during which time period the reaction of the components of the composition with the rust is completed but no further corrosion takes place,
(e) applying a second high-intensity water spray to the surface to remove any unreacted tannic and phosphoric acids, followed by draining of excess water,
(f) brushing or spraying on of a second application of the composition of this invention,
(g) allowing the surface to dry at least than 12 hours but not more than 24 hours, for the same reason as under d above,
(h) rinsing the surface with an aqueous alkali bicarbonate solution, such as sodium or potassium bicarbonate, for three minutes, the concentration range being 3–7% w/v, with 5% w/v being the preferred concentration, whereby this rinsing procedure neutralizes any unreacted acids remaining on the surface which would prevent adhesion of organic paint coatings subsequently applied,
(i) rinsing the surface with flowing water for no less than one minute to insure complete removal of the alkali bicarbonate solution, and
(j) allowing the surface to dry for at least one hour but not more than 12 hours before applying an organic paint coating, whereby the twelve-hour limit precludes significant new corrosion.

The superior effectiveness of the composition and of the method in accordance with this invention for converting corrosion into an adherent substrate for paint coatings is illustrated by the following tests and evaluations as shown in Table III.

TABLE III

| Test | Test Standard | ASTM Evaluation |
|---|---|---|
| Wet Adhesion | FTMS 141 Method 6301.2 | ASTM D3359 |
| Salt Spray (scribed) | ASTM B117 | ASTM D1654 |
| Salt Spray (unscribed) | ASTM B117 | ASTM D610 & D714 |

wherein the following is an identification of each of the test standards and evaluations:

FTMS—Federal Test Method Standard
ASTM—American Society for Testing and Materials
FTMS 141 Method 6301.2—"Adhesion (wet) tape test"
ASTM B117—"Standard Method of Salt Spray (Fog) Testing"
ASTM D610—"Method for Measuring Adhesion by Tape Test"
ASTM D714—"Method for Evaluating Degree of Blistering of Paints"
ASTM D1654—"Method for Evaluation of Painted or Coated Specimens Subjected to Corrosive Environments"
ASTM D3359—"Method for Measuring Adhesion by Tape Test"

"Scribed" refers to a process as detailed in ASTM D1654 of scratching a line on the test sample with a sharp object such as a nail and evaluating the extent of corrosion around the line. "Unscribed" refers to tests in which the test sample was not scribed as defined above.

Note: All ASTM standards are published in the 1987 Annual Book of ASTM Standards, Volume 6.01.

Tests showed that the improved composition of this invention, when applied according to the method of this invention, provides superior corrosion protection for steel surfaces when compared to two of the most highly considered commercial rust converter products, as set forth in Table IV.

TABLE IV

| Test | Standard | Method | Composition | Rating | Scale (3) |
|---|---|---|---|---|---|
| wet adhesion | FTMS 141 Mtd. 6301.2 | ASTM D3359 | this invention | 4.0 | 0–5 |
| | | | commercial (1) | 3.5 | " |
| | | | commercial (2) | 1.0 | " |

TABLE IV-continued

| Test | Standard | Method | Composition | Rating | Scale (3) |
|---|---|---|---|---|---|
| salt spray | ASTM B117 | ASTM D610 | this invention | 8.7 | 0–10 |
| resistance | | | commercial (1) | 7.0 | " |
| (unscribed) | | | commercial (2) | 8.0 | " |
| salt spray | ASTM B117 | ASTM D714 | this invention | 10.0 | 0–10 |
| resistance | | | commercial (1) | 6.0 | " |
| (unscribed) | | | commercial (2) | 10.0 | " |
| salt spray | ASTM B117 | ASTM D1654 | this invention | 6.0 | 0–10 |
| resistance | | | commercial (1) | 5.3 | " |
| (scribed) | | | commercial (2) | 6.0 | " |

Notes:
(1) tannic acid based;
(2) phosphoric acid based;
(3) the highest number on each scale is optimum.

Both commercial products were found to cause extensive delamination of the paint after six months of exposure to an aggressive environment. It was also found that after this period, the commerical products promoted rather than retarded corrosion. Test surfaces treated with the composition of this invention by the method of this invention did not show delamination of paint, nor was corrosion promoted by the composition of this invention.

From the foregoing description and explanation, it is apparent that the objectives of this invention have been achieved with greatly improved results.

While specific embodiments of this invention have been described, it will be understood that other modifications thereof may be suggested by those skilled in the art without departing from the scope of the appended claims.

We claim:

1. A method for converting corroded steel surfaces to adherent substrates suitable for accepting organic coatings comprising the steps of:

(a) applying a first high-intensity water spray to the surface;

(b) draining excess water from the surface;

(c) applying thereon a first coat of a composition comprising the following ingredients, with their respective volume or weight percentage ranges:

| | |
|---|---|
| an aliphatic alcohol | 2–20% v/v |
| phosphoric acid | 5–15% v/v |
| an alkali nitrate | 0.3–3% w/v |
| tannic acid | 0.1–2% w/v |
| zinc nitrate | 0.3–3% w/v |
| surface active agent | 0.1–1% w/v and |

-continued

| | |
|---|---|
| water, softened | balance |

wherein % v/v denotes volume percent, e.g. ml per 100 ml of solution, and % w/v denotes weight percent, e.g. grams per 100 ml of solution, (d) allowing the surface to dry at least 12 hours but not more than 24 hours, (e) applying a second high-intensity water spray to the surface to remove any unreacted ingredients of said composition, (f) draining excess water from the surface;

(g) applying thereon a second coat of said composition (h) allowing the surface to dry at least 12 hours but not more than 24 hours, (i) rinsing the surface with aqueous alkali bicarbonate solution for sufficient time to remove any unreacted ingredients of said composition, (j) rinsing the surface with flowing water for sufficient time to completely remove any alkali bicarbonate solution, and (k) allowing it to dry for at least one hour but not more than 12 hours, thereby forming a adherent substrate for better adhesion of paint.

2. The method in accordance with claim 1 wherein the composition is brushed onto the surface.

3. The method in accordance with claim 1 in which the composition is sprayed onto the surface.

4. The method in accordance with claim 1 wherein said rinsing in step i is carried out with an aqueous alkali bicarbonate solution selected from the group consisting of sodium bicarbonate and potassium bicarbonate.

5. The method in accordance with claim 1 wherein said rinsing in step i is carried out with an alkali bicarbonate solution having a concentration from 3.0 to 7.0% w/v.

* * * * *